US009400479B1

(12) United States Patent
Ueno et al.

(10) Patent No.: US 9,400,479 B1
(45) Date of Patent: Jul. 26, 2016

(54) WASTE TONER CONTAINER AND IMAGE FORMING APPARATUS

(71) Applicant: FUJI XEROX CO., LTD., Tokyo (JP)

(72) Inventors: Hirofumi Ueno, Kanagawa (JP); Akira Harada, Kanagawa (JP); Atsushi Kaneko, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/923,933

(22) Filed: Oct. 27, 2015

(30) Foreign Application Priority Data

May 21, 2015 (JP) ..... 2015-103410

(51) Int. Cl.
*G03G 21/12* (2006.01)
*G03G 21/20* (2006.01)

(52) U.S. Cl.
CPC ..... *G03G 21/12* (2013.01); *G03G 21/206* (2013.01)

(58) Field of Classification Search
CPC .. G03G 21/12; G03G 15/0898; G03G 21/206
USPC ..... 399/98, 360
See application file for complete search history.

(56) References Cited

U.S. PATENT DOCUMENTS 5,349,427 A * 9/1994 Benedict et al. ..... 399/360
2008/0260441 A1 * 10/2008 Takagi et al. ..... 399/360

FOREIGN PATENT DOCUMENTS

JP H06-138767 A 5/1994
JP 2014-071235 A 4/2014

* cited by examiner

*Primary Examiner* — Hoang Ngo
(74) *Attorney, Agent, or Firm* — Oliff PLC

(57) ABSTRACT

A waste toner container includes a waste toner container body and a dust collector. The waste toner container body has a first end and stores waste toner discharged from an apparatus body. The dust collector is disposed on a first end side of the waste toner container body, allows passage therethrough of air to be exhausted from the apparatus body, and traps dust that enters the dust collector together with an airflow.

9 Claims, 8 Drawing Sheets

WASTE TONER CONTAINER AND IMAGE FORMING APPARATUS

CROSS-REFERENCE TO RELATED APPLICATIONS

This application is based on and claims priority under 35 USC 119 from Japanese Patent Application No. 2015-103410 filed May 21, 2015.

BACKGROUND

Technical Field

The present invention relates to a waste toner container and an image forming apparatus.

SUMMARY

According to an aspect of the present invention, a waste toner container includes a waste toner container body and a dust collector. The waste toner container body has a first end and stores waste toner discharged from an apparatus body. The dust collector is disposed on a first end side of the waste toner container body, allows passage therethrough of air to be exhausted from the apparatus body, and traps dust that enters the dust collector together with an airflow.

BRIEF DESCRIPTION OF THE DRAWINGS

Exemplary embodiments of the present invention will be described in detail based on the following figures, wherein.

DETAILED DESCRIPTION

Figure 1:
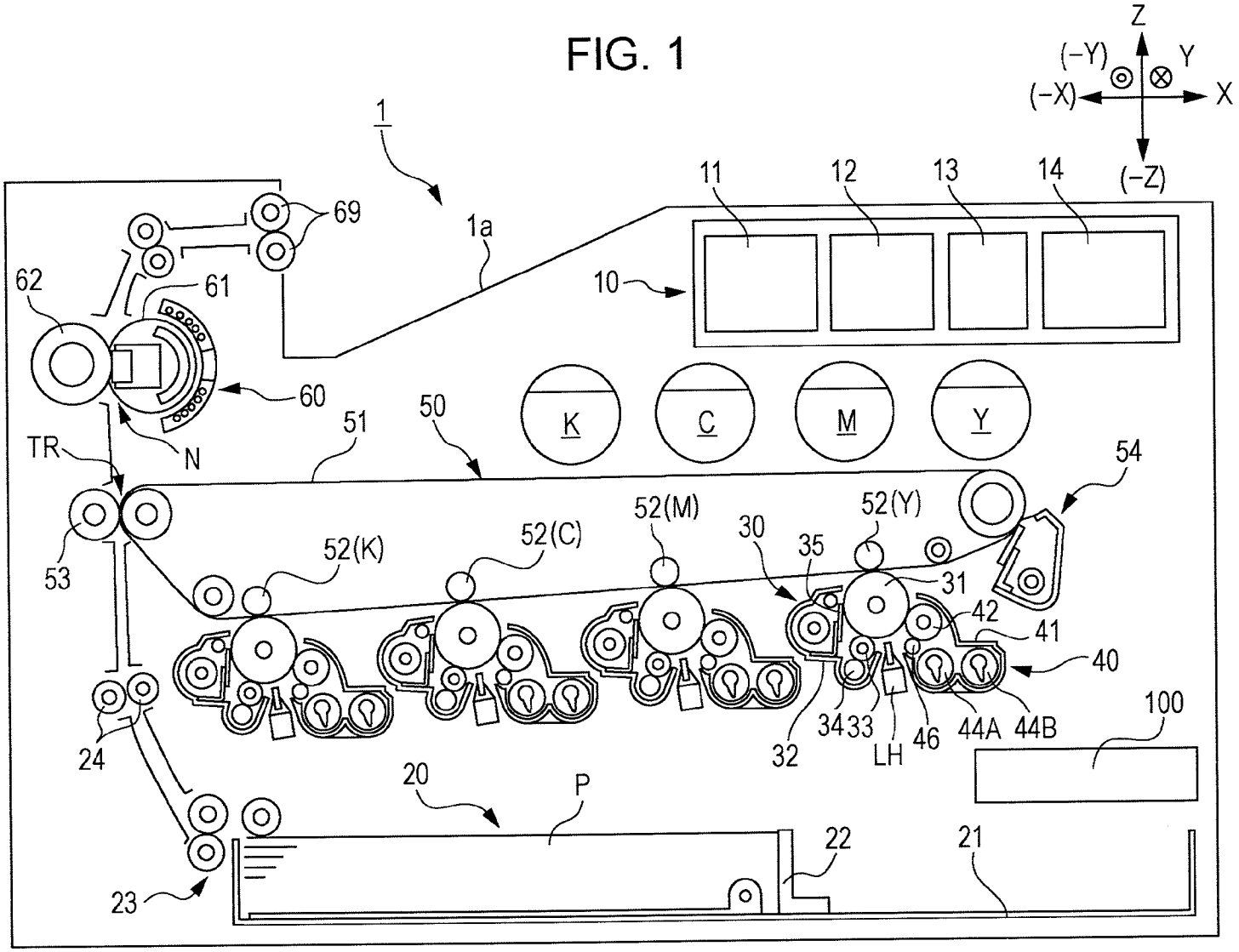
FIG. 1 is a schematic sectional view of an internal structure of an image forming apparatus.

Next, exemplary embodiments and specific examples according to the present invention will be described with reference to the drawings in further detail below. It should be understood that the present invention is not limited to the exemplary embodiments and the specific examples.

Furthermore, it should be noted that the drawings referred to in the following description are schematically illustrated and not to scale, and illustration of elements not required for the description is omitted as appropriate for ease of understanding.

For ease of understanding of the description hereafter, the front-rear direction, the left-right direction, and the vertical direction are respectively defined as the X direction, the Y direction, and the Z direction in the drawings.

First Exemplary Embodiment

(1) An Overall Structure and Operations of an Image Forming Apparatus

FIG. 1 is a schematic sectional view of an internal structure of an image forming apparatus 1 to which a waste toner container 100 according to a first exemplary embodiment is attached.

An overall structure and operations of the image forming apparatus 1 are described below with reference to the drawings.

The image forming apparatus 1 includes a controller 10, a sheet feed device 20, photosensitive units 30, developing devices 40, a transfer device 50, and a fixing device 60. An output tray 1*a* is formed on an upper (+Z direction) surface of the image forming apparatus 1. Sheets of paper in which images are recorded are output to and received by the output tray 1*a*.

The controller 10 includes components such as an image-forming-apparatus controller 11, a data converter 12, a light exposure controller 13, and a power source unit 14. The image-forming-apparatus controller 11 controls operations of the image forming apparatus 1. The data converter 12 prepares image data in response to a print processing request. The light exposure controller 13 controls turning on of lighting by a light exposure devices LH. The power source unit 14 applies high voltages to components such as charging rollers 32, developing rollers 42, first transfer rollers 52, and a second transfer roller 53, which are to be described later. The power source unit 14 also supplies power to the light exposure devices LH, the sheet feed device 20, the fixing device 60, and sensors and the like provided in these components.

The data converter 12 converts print information received from an external information transmission device (for example, a personal computer or the like) into image information for forming a latent image and outputs this image information to the light exposure devices LH in the form of drive signals at preset timing. The light exposure devices LH according to the present exemplary embodiment each include a light-emitting-diode (LED) head in which plural LEDs are linearly arranged in a main scanning direction.

The sheet feed device 20 is provided at a bottom portion of the image forming apparatus 1. The sheet feed device 20 includes a sheet loading plate 21. Many sheets of paper P are loaded on an upper surface of the sheet loading plate 21. Each of the sheets P serves as a recording medium. The position in the width direction of the sheets P loaded on the sheet loading plate 21 is determined by a regulating plate (not illustrated). These sheets P are drawn forward (−X direction) one after another from the uppermost sheet by a sheet drawing member 22. Each of the sheets P having been drawn is then transported to a nip of a registration roller pair 23.

The photosensitive units 30 are arranged parallel to one another above (+Z direction) the sheet feed device 20 and include respective photosensitive drums 31, which are rotated. The charging roller 32, the light exposure device LH, the developing device 40, the first transfer roller 52, and a cleaning blade 34 are arranged around each of the photosensitive drums 31 in a rotating direction of the photosensitive drum 31. A cleaning roller 33 that cleans a surface of the charging roller 32 is disposed so as to face and be in contact with the charging roller 32.

The developing device 40 includes a developing housing 41 that contains developer therein. The developing roller 42 and a pair of transport augers 44A and 44B are disposed in the developing housing 41. The developing roller 42 that serves as a developer holding body faces the photosensitive drum 31. The transport augers 44A and 44B are disposed on a lower rear side of the developing roller 42. The transport augers 44A and 44B agitate the developer and transport the developer to the developing roller 42 side. A layer thickness regulating member 46 that regulates the thickness of a layer of the developer is disposed near the developing roller 42.

There are no big differences between the structures of the developing devices 40 except for the developer contained in the developing housings 41. Yellow (Y), magenta (M), cyan (C), and black (K) toner images are formed by the respective developing devices 40.

The surface of the rotating photosensitive drum 31 is charged by the charging roller 32. An electrostatic latent image is formed on the charged surface of the photosensitive drum 31 by latent-image forming light emitted from the light exposure device LH. The electrostatic latent image formed on the photosensitive drum 31 is developed into a toner image by the developing roller 42.

The transfer device 50 includes an intermediate transfer belt 51 and first transfer rollers 52. The toner images of the colors formed on the photosensitive drums 31 of the photosensitive units 30 are transferred onto the intermediate transfer belt 51 so as to be superposed on one another. The first transfer rollers 52 sequentially transfer (first transfer) the toner images of the colors formed by the photosensitive units 30 onto the intermediate transfer belt 51. The transfer device 50 further includes the second transfer roller 53 and an intermediate-transfer-belt cleaner 54. The second transfer roller 53 collectively transfers (second transfer) the toner images of the colors having been transferred onto the intermediate transfer belt 51 so as to be superposed on one another onto the sheet P that serves as the example of the recording medium. The intermediate-transfer-belt cleaner 54 removes residual toner attracted to the intermediate transfer belt 51.

The toner images of the colors formed on the photosensitive drums 31 of the photosensitive units 30 are sequentially electrostatically transferred (first transfer) onto the intermediate transfer belt 51 by the first transfer rollers 52 to each of which a specified transfer voltage is applied from the power source unit 14 or the like controlled by the image-forming-apparatus controller 11. Thus, superposed toner images formed of the toner images of the colors superposed one another are formed.

Due to a movement of the intermediate transfer belt 51, the superposed toner images on the intermediate transfer belt 51 are transported to a region (second transfer portion TR) where the second transfer roller 53 is disposed. When the superposed toner images are transported to the second transfer portion TR, the sheet P is supplied from the sheet feed device 20 to the second transfer portion TR at timing adjusted to the transportation of the superposed toner images. A specified transfer voltage is applied from the power source unit 14 or the like controlled by the image-forming-apparatus controller 11 to the second transfer roller 53, thereby collectively transferring the superposed toner images from the intermediate transfer belt 51 onto the sheet P fed by the registration roller pair 23 and guided by a transport guide.

The residual toner on the surfaces of the photosensitive drums 31 is removed by the cleaning blades 34 and collected in the waste toner container 100. The surfaces of the photosensitive drums 31 are charged again by the charging rollers 32. Remaining matter that has not been removed by the cleaning blades 34 and is attracted to the charging rollers 32 is collected on the surfaces of the cleaning rollers 33, which are rotated and in contact with the charging rollers 32, and accumulated.

The fixing device 60 includes a heating module 61 and a pressure module 62. A fixing nip N (fixing region) is defined in a region where the heating module 61 and the pressure module 62 are in pressure contact with each other.

The sheet P onto which the toner images have been transferred by the transfer device 50 but have not yet been fixed is transported to the fixing device 60 through the transport guide. The sheet P transported to the fixing device 60 is subjected to pressure and heat applied thereto by a pair of the heating module 61 and the pressure module 62. Thus, the toner images are fixed.

The sheet P on which a fixed toner image has been formed is output from an output roller pair 69 to the output tray 1*a* in the upper surface of the image forming apparatus 1.

(2) The Waste Toner Container

Figure 2:
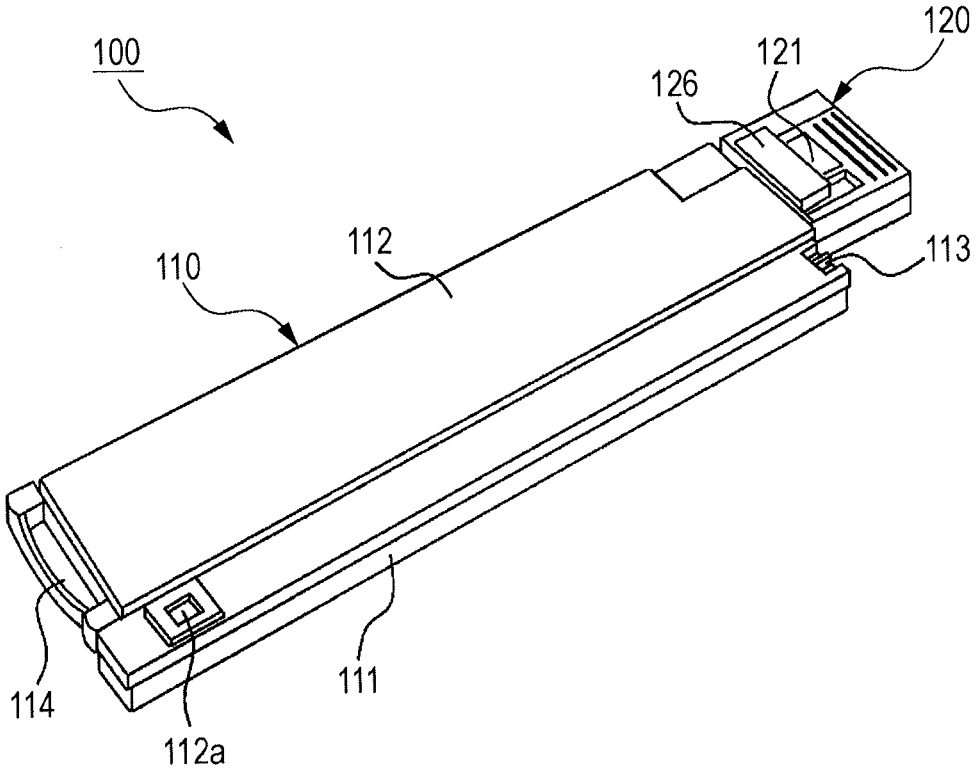
FIG. 2 is a perspective view of an outline structure of a waste toner container.
Figure 3:
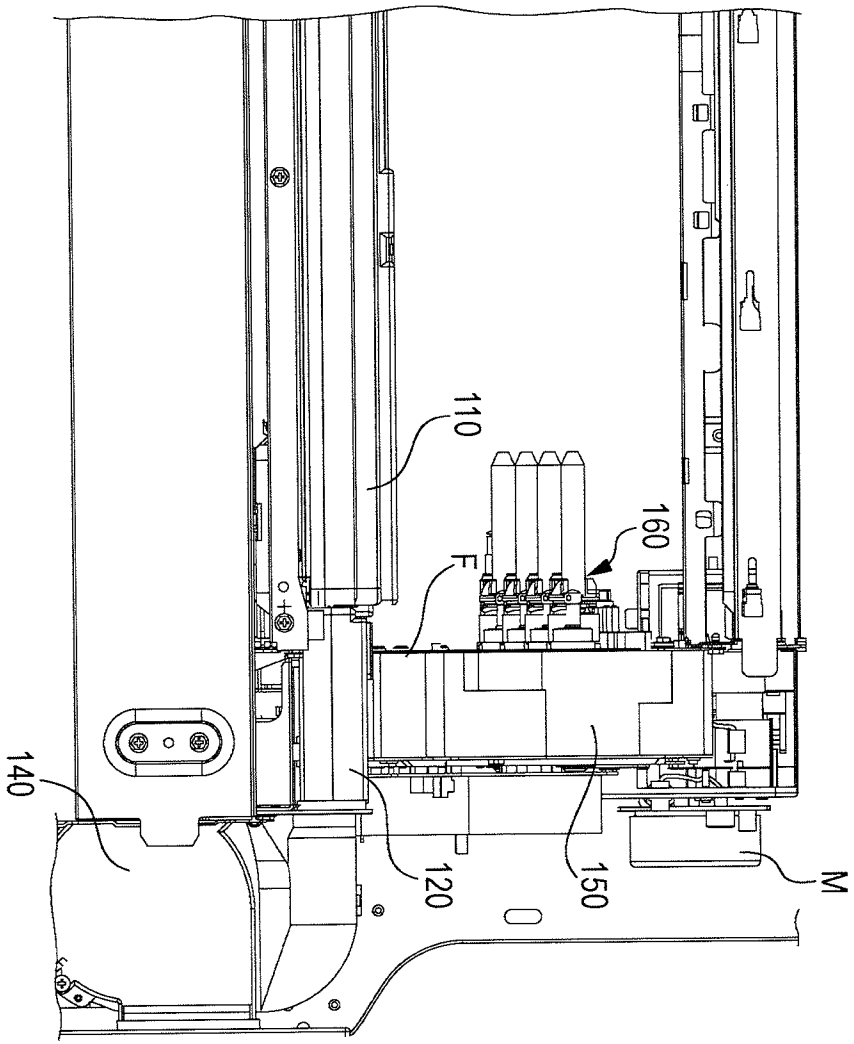
FIG. 3 is a schematic sectional view of an apparatus body with the waste toner container and a drive force transmission device are attached thereto.
Figure 4:
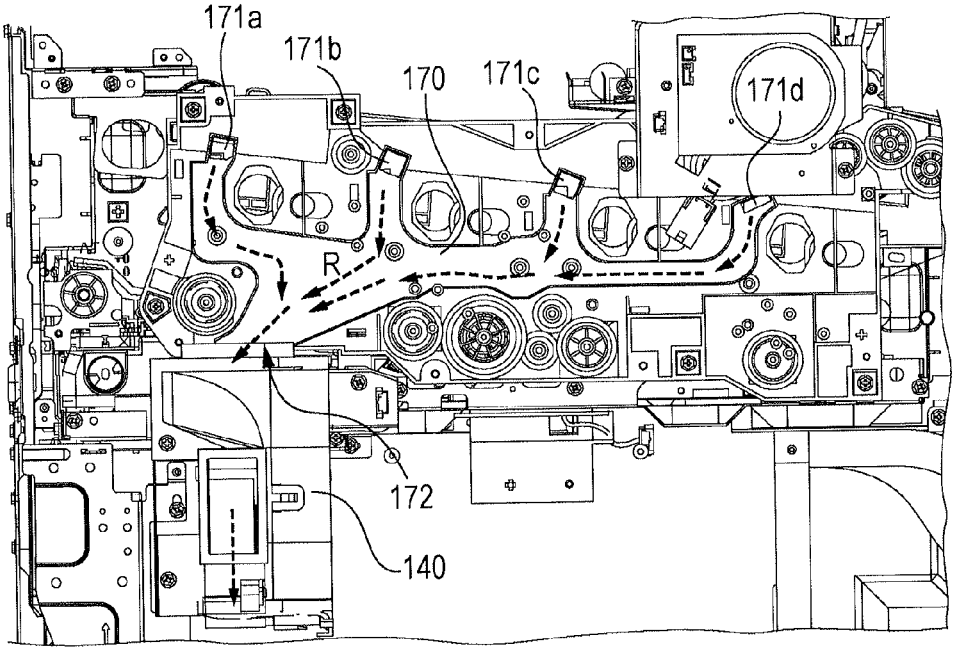
FIG. 4 is a schematic longitudinal sectional view illustrating exhaust of air in the apparatus body.
Figure 5A:
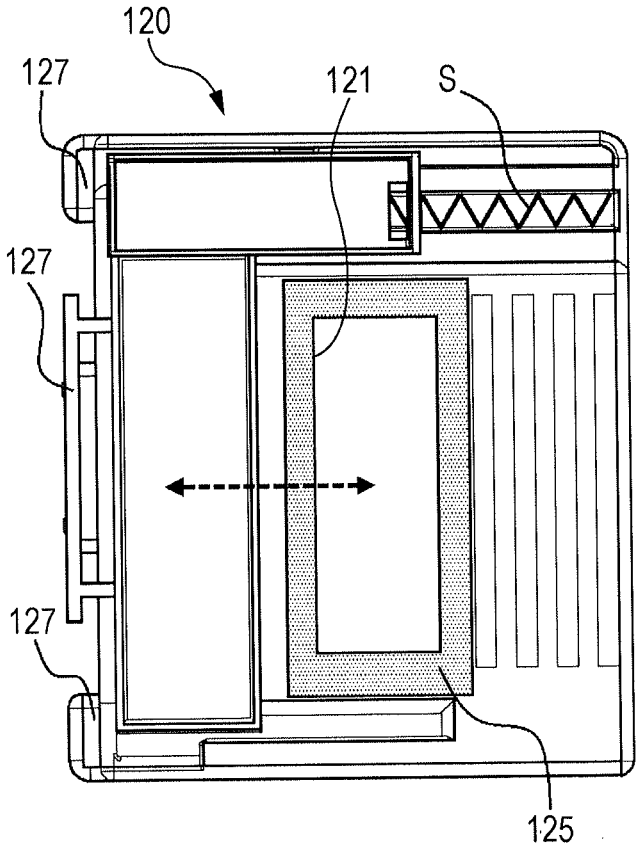
FIG. 5A is a plan view of a dust collector.
Figure 5C:
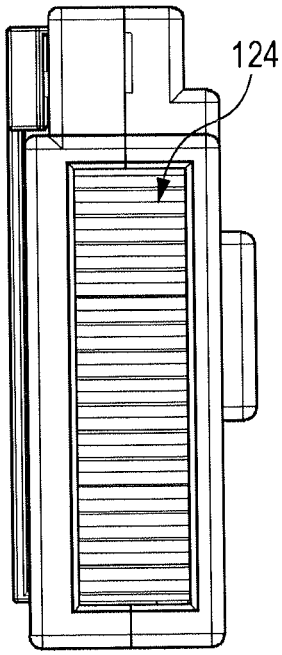
FIG. 5C is a right side view of an air outlet.
Figure 5B:
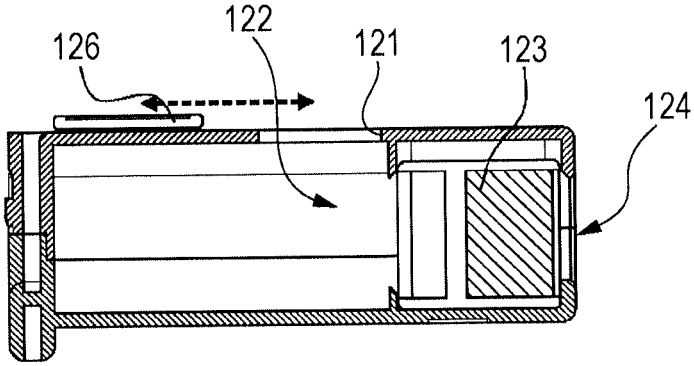
FIG. 5B is a longitudinal sectional view of an internal structure of the dust collector.
Figure 6A:
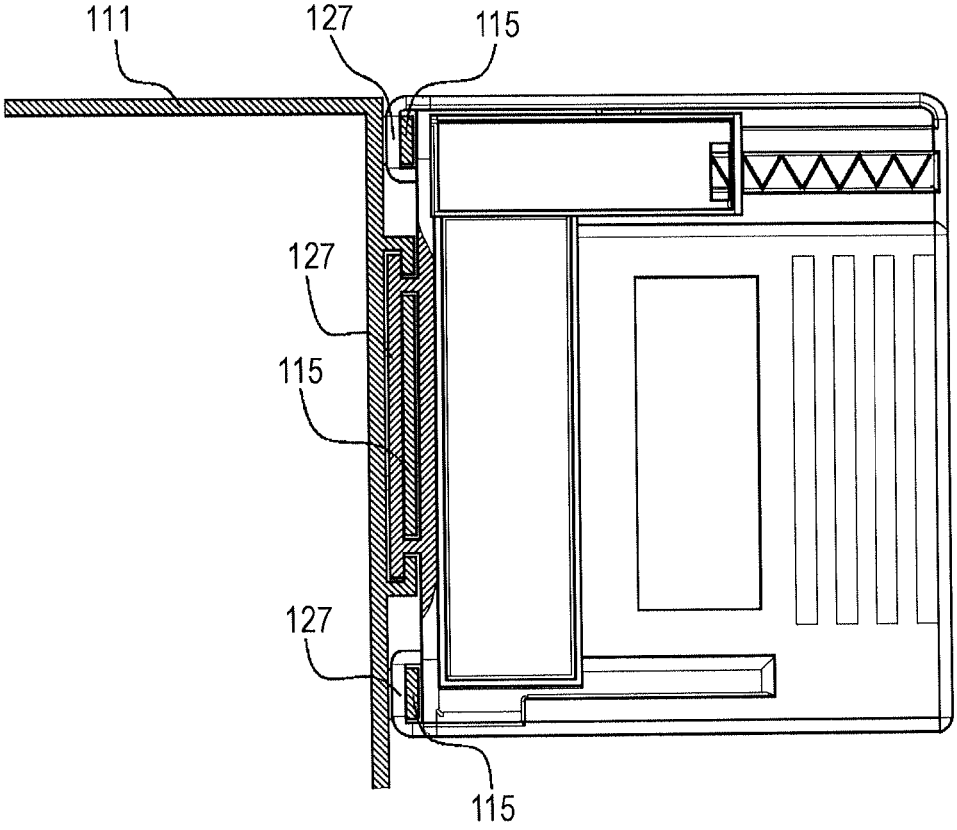
FIG. 6A is a schematic plan view which includes part of a cross sectional view of an integrated state of the waste toner container body and the dust collector.
Figure 6B:
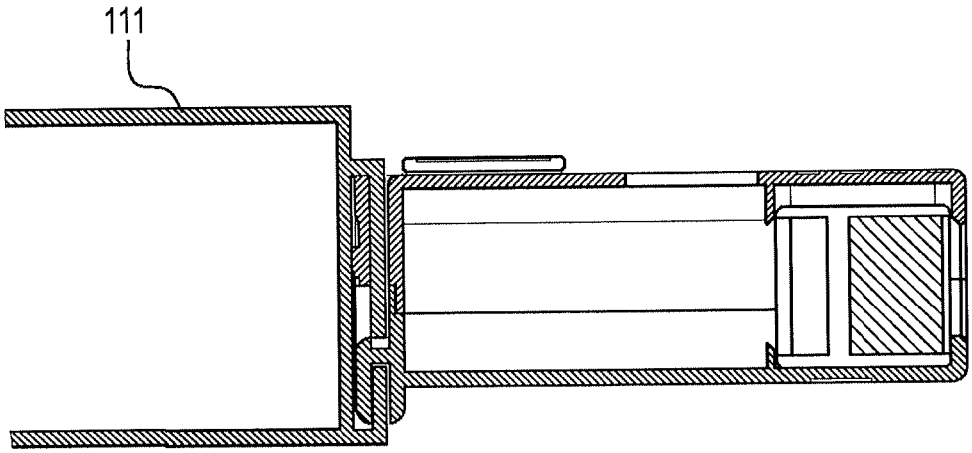
FIG. 6B is a schematic sectional view of the waste toner container body and the dust collector.

FIG. 2 is a perspective view of an outline structure of the waste toner container 100. FIG. 3 is a schematic sectional view of an apparatus body with the waste toner container 100 and a drive force transmission device 150 attached thereto. FIG. 4 is a schematic longitudinal sectional view illustrating exhaust of air in the apparatus body. FIG. 5A is a plan view of a dust collector 120, FIG. 5B is a longitudinal sectional view of an internal structure of the dust collector 120, and FIG. 5C is a right side view of an air outlet 124. FIG. 6A is a schematic plan view which includes part of a cross sectional view of an integrated state of the waste toner container body 110 and the dust collector 120. FIG. 6B is a schematic sectional view of the waste toner container body 110 and the dust collector 120.

The structure of the waste toner container 100 is described below with reference to the drawings.

(2.1) Collection of Waste Toner

After the toner images developed on the photosensitive drums 31 have been transferred onto the sheet P, the residual toner remaining on the surfaces of the photosensitive drums 31 is removed by the cleaning blades 34 in the image forming apparatus 1. The removed residual toner is collected in the waste toner container 100 of the image forming apparatus 1 as the waste toner.

Furthermore, after the toner images have been transferred from the intermediate transfer belt 51 to the sheet P through the second transfer, the residual toner attracted onto the intermediate transfer belt 51 is also removed by the intermediate-transfer-belt cleaner 54 and collected in the waste toner container 100 of the image forming apparatus 1.

Furthermore, in order to omit replacement work of degraded developer (used developer) in the developing devices 40 using two-component developer containing the toner and carrier, trickle development may be used. In the trickle development, the degraded developer is discharged while replenishment of new two-component developer and replenishment of the toner are simultaneously performed. When such a trickle development method is adopted, the degraded developer discharged from the developing devices 40 of the colors is also collected in the waste toner container 100.

(2.2) Collection of Dust

The drive force transmission device 150, which is secured to a rear surface side of a housing F as illustrated in FIG. 3, transmits a rotating drive force of a drive motor M to the photosensitive units 30, the developing devices 40, and the transfer device 50 so as to perform an image forming operation in the image forming apparatus 1.

The drive motor M is attached to the drive force transmission device 150, a drive transmission part 160 is secured to the housing F of the apparatus body such that the drive transmission part 160 projects from the housing F of the apparatus body to an inner surface side of the apparatus body, and air inlets 171*a*, 171*b*, 171*c*, and 171*d* (illustrated in FIG. 4) of an air channel 170, which are provided on a drive force transmission side of the drive force transmission device 150, are open on the inner surface side of the apparatus body.

As illustrated in FIG. 4, in the image forming apparatus 1 that includes the drive force transmission device 150 having the above-described structure, the air in the apparatus body including the air in regions around the photosensitive units 30, the developing devices 40, and the transfer device 50, which are disposed in the apparatus body, flows as follows: the air is sucked through the air inlets 171*a*, 171*b*, 171*c*, and 171*d*, passes through the air channel 170, and is introduced into the dust collector 120 of the waste toner container 100 through an air outlet 172. The air that contains a toner cloud, foreign matter, and the like having been introduced into the dust collector 120 is purified while passing through the dust collector 120 and compressed and exhausted to the outside of the apparatus body by an air exhaust fan 140 (see arrows R of FIG. 4). The toner cloud and the foreign matter each serve as an example of the dust.

(2.3) An Overall Structure of the Waste Toner Container

As illustrated in FIG. 2, the waste toner container 100 includes a waste toner container body 110 and the dust collector 120. The residual toner removed from the surfaces of the photosensitive drums 31 by the cleaning blades 34 of the photosensitive units 30 is stored in the waste toner container body 110.

The dust collector 120 allows the air in the image forming apparatus 1 to pass therethrough and traps the dust that enters the dust collector 120 together with the air flow.

(2.4) The Waste Toner Container

The waste toner container body 110 includes a container housing 111 in which the discharged waste toner is stored and a container covering 112 that is engaged with the container housing 111 so as to define a storage chamber.

A transport auger (not illustrated) that transports the waste toner is rotatably supported in the container housing 111 and rotates the waste toner, so that the waste toner is transported in the rotational axis direction of the transport auger and stored in the container housing 111.

The container covering 112 has an inlet 112*a* through which the discharged waste toner flows in. A shutter (not illustrated) is disposed at the inlet 112*a* so as to open and close the inlet 112*a*. A light blocking piece 113 is provided on the dust collector side of the container covering 112. The light blocking piece 113 is used to detect whether or not the waste toner container 100 is attached to the image forming apparatus 1. The image forming apparatus 1 includes a photosensor (not illustrated) that includes a light emitter on one side and a light receiver on another side. Whether or not the waste toner container 100 is attached is determined in accordance with whether or not light is blocked by the light blocking piece 113.

A handle 114 is provided on a one end side of the waste toner container body 110. The handle 114 is held when the waste toner container 100 is attached to or detached from the apparatus body. An operator may easily attach or detach the waste toner container 100 by holding and operating the handle 114.

(2.5) The Dust Collector

As illustrated in FIGS. 5A and 53, the dust collector 120 has an air inlet 121, an air channel 122, a filter member 123, and the air outlet 124. The air channel 122 extends so as to be bent relative to the air inlet 121 and allows the air to pass therethrough. The filter member 123 is disposed in the air channel 122 and traps the dust that enters the filter member 123 together with the airflow. The air outlet 124 faces the outside.

The air inlet 121 is open at an upper surface of the dust collector 120 and connected to the air outlet 172 of the air channel 170 provided in the apparatus body.

An elastic sealing member 125 is stuck onto a region around the opening of the air inlet 121. The sealing member 125 is compressed so as to suppress leakage of the dust in a state in which the air inlet 121 is connected to the air outlet 172 of the apparatus body.

The dust collector 120 includes a shutter member 126 movable between a position where the shutter member 126 opens the air inlet 121 and a position where the shutter member 126 closes the air inlet 121 (see an arrow in FIGS. 5A and 5B). The shutter member 126 is constantly urged by a coil spring S serving as an urging member in a direction in which the shutter member 126 closes the air inlet 121.

Thus, the air inlet 121 is closed by the shutter member 126 in a state in which the waste toner container 100 is detached from the apparatus body. This suppresses the leakage of the trapped dust to the outside through the air inlet 121.

The air inlet 121 is connected to the air channel 122 that is bent so as to extend toward the air outlet 124 in an inner space of the dust collector 120. The filter member 123 is disposed upstream of the air outlet 124 in the air channel 122. The filter member 123 is formed of a porous material that removes toner cloud, foreign matter, and the like. The examples of the material of the filter member 123 include, for example, nonwoven fabric such as polyolefin-based or polyester-based synthetic fiber or glass fiber. The filter member 123 has a zigzag folded bellows shape.

The air outlet 124 is formed on a surface of the dust collector 120 and connected to the air exhaust fan 140 provided in the apparatus body. The air is purified by trapping the toner cloud, the foreign matter, and the like contained therein by using the filter member 123 and exhausted to the outside of the apparatus body.

Engagement portions 127 are formed on a surface of the dust collector 120 opposite to the surface where the air outlet 124 is formed. The engagement portions 127 are engaged with engagement portions 115 formed in the container housing 111 of the waste toner container body 110 so as to be integrally connected to the waste toner container body 110.

As illustrated in FIGS. 6A and 6B, the engagement portions 115 formed on the container housing 111 and the engagement portions 127 of the dust collector 120 are engaged with one another, so that the dust collector 120 is integrated with the waste toner container body 110.

(3) Replacement of the Waste Toner Container

Figure 7:
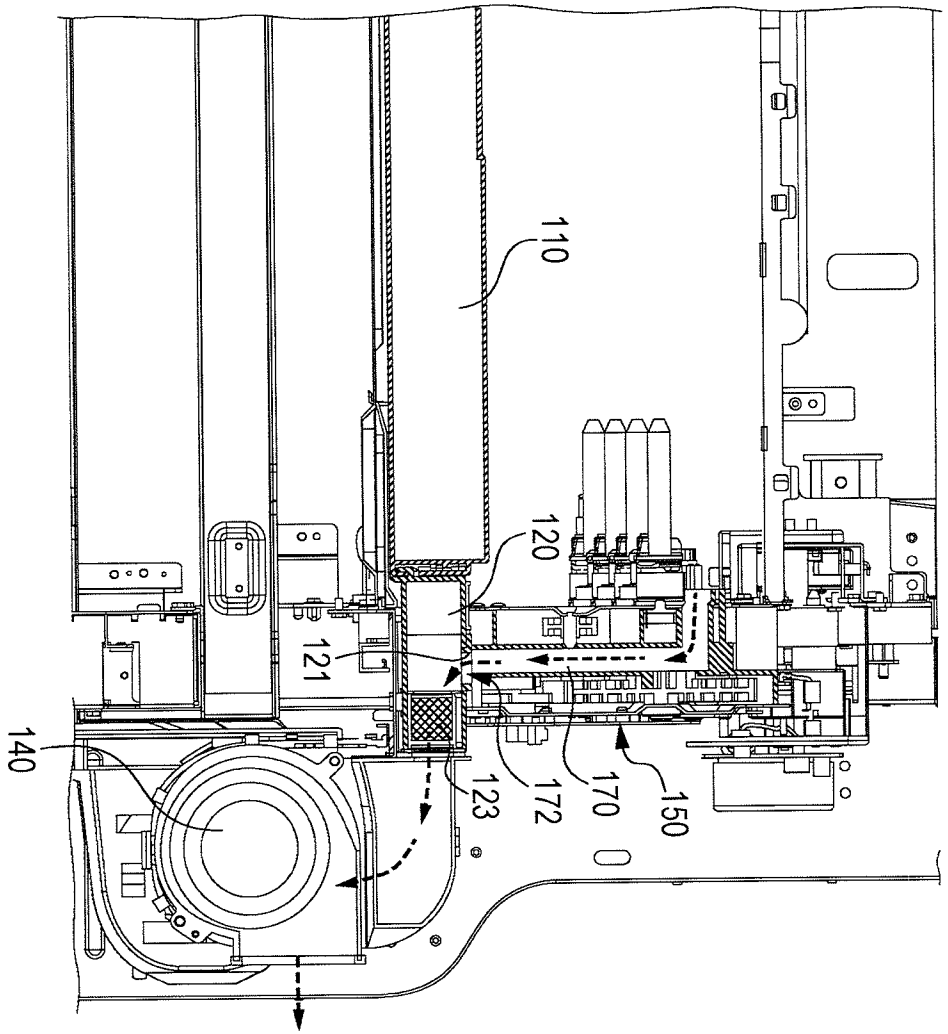
FIG. 7 is a schematic sectional view of connection of the waste toner container, the drive force transmission device, and an air exhaust fan.

FIG. 7 is a schematic sectional view of connection of the waste toner container 100, the drive force transmission device 150, and the air exhaust fan 140.

As illustrated in FIG. 7, in a state in which the waste toner container 100 formed by integrating the waste toner container body 110 and the dust collector 120 to each other is attached to the apparatus body, the air inlet 121 of the dust collector 120 is connected to the air outlet 172 of the air channel 170 formed in the drive force transmission device 150.

Furthermore, the air outlet 124 of the dust collector 120 is connected to an air inlet of the air exhaust fan 140.

As a result, an internal space of the apparatus body is connected to the air exhaust fan 140 with the air channel 170 and the dust collector 120 interposed therebetween, and the air containing the toner cloud, foreign matter, and the like in the apparatus body including the regions around the photosensitive units 30, the developing devices 40, and the transfer device 50, which are disposed in the apparatus body, is introduced into the dust collector 120 of the waste toner container 100 through the air channel 170. The air having been introduced into the dust collector 120 is purified by trapping the toner cloud, foreign matter, and the like by using the filter member 123 while passing through the dust collector 120 and compressed and exhausted to the outside of the apparatus body by the air exhaust fan 140.

The toner cloud, foreign matter, and the like having been trapped are accumulated in the filter member 123 disposed in the dust collector 120. Thus, the filter member 123 needs to be replaced after the filter member 123 has been used for a certain period of time.

The waste toner container body 110 and the dust collector 120 where the filter member 123 is disposed are integrated with each other in the waste toner container 100 according to the present exemplary embodiment. Thus, when the waste toner container 100 filled with the collected waste toner is replaced, the filter member 123 is also replaced.

This may facilitate the replacement of the filter member 123 and prevent the filter member 123 in the dust collector 120 from being left unreplaced.

Second Exemplary Embodiment

Figure 8A:
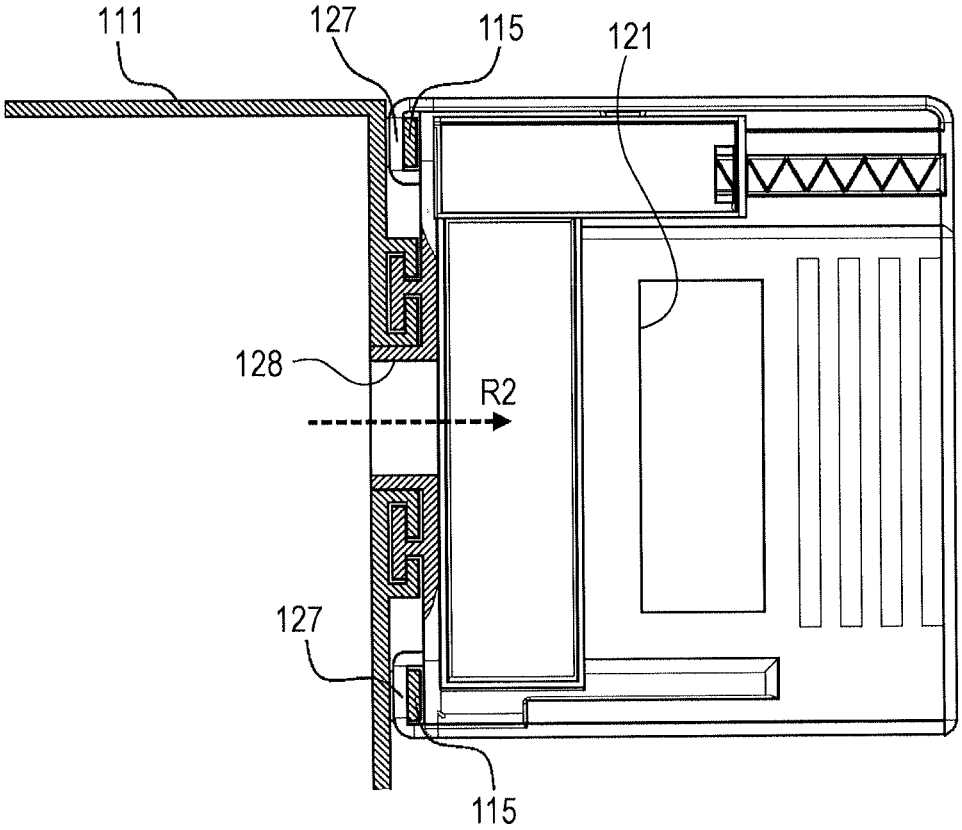
FIG. 8A illustrates a schematic plan view which includes part of a cross sectional view of an integrated state of a waste toner container body and a dust collector in a waste toner container.
Figure 8B:
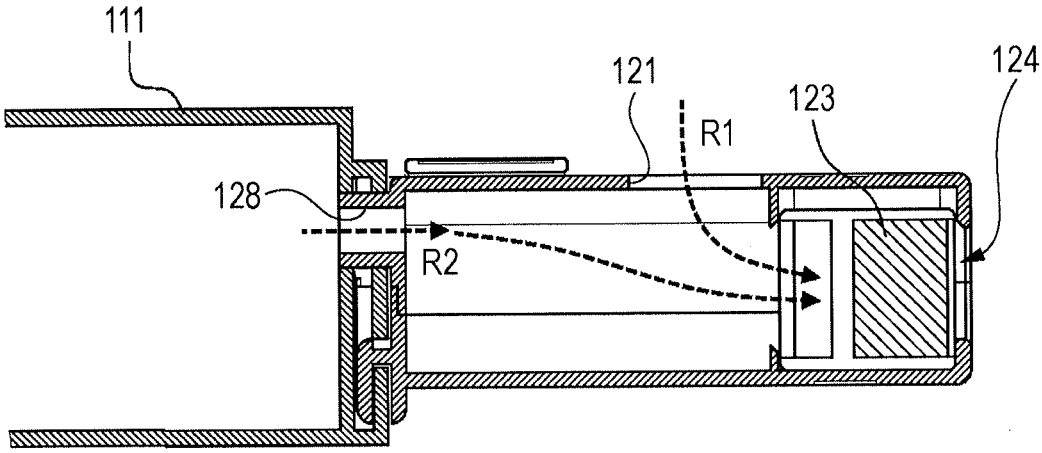
FIG. 8B is a schematic longitudinal sectional view of the waste toner container body and the dust collector.

FIG. 8A is a schematic plan view which includes part of a cross sectional view of an integrated state of a waste toner container body 110A and a dust collector 120A in a waste toner container 100A. FIG. 8B is a schematic longitudinal sectional view of the waste toner container body 110A and the dust collector 120A.

In the waste toner container 100A according to a second exemplary embodiment, the engagement portions 115 of the container housing 111 and the engagement portions 127 of the dust collector 120A are engaged with one another, so that the dust collector 120A is integrated with the waste toner container body 110A while the waste toner container body 110A and the dust collector 120A are connected to each other through a through hole 128.

The dust collector 120A has the air inlet 121 and the through hole 128. The air inlet 121 is connected to the air outlet 172 of the air channel 170 provided in the apparatus body. The through hole 128 is connected to the waste toner container body 110A. The air in the waste toner container body 110A together with the air in the apparatus body is exhausted to the outside of the apparatus body after the toner cloud, foreign matter, and the like contained therein have been trapped by the filter member 123 (see R1 and R2 of FIGS. 8A and 8B).

The waste toner container body 110A is connected to the inside of each of the developing housings 41 of the developing devices 40 through the inlet 112*a* through which the discharged waste toner flows in. Thus, the degraded developer discharged from the developing devices 40 of the colors is also collected in the waste toner container body 110A.

The waste toner after transfer is collected in the waste toner container body 110A. As the amount of the collected toner increases, an inner pressure of the waste toner container body 110A increases, and accordingly, inner pressures of the developing housings 41 of the developing devices 40 connected to the waste toner container body 110A increase. This may lead to blow-off of the toner cloud.

The waste toner container body 110A and the dust collector 120A of the waste toner container 100A are connected through the through hole 128, and the air in the waste toner container body 110A is purified by the filter member 123 and exhausted to the outside of the apparatus body. Thus, the increase in the inner pressure of the waste toner container body 110A may be suppressed.

As a result, the blow-off of the toner cloud due to the increase in the inner pressures of the developing housings 41 of the developing devices 40 may be suppressed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A waste toner container comprising:

a waste toner container body that has a first end and that stores waste toner discharged from an apparatus body; and a dust collector that is disposed on the first end side of the waste toner container body, that allows passage therethrough of air to be exhausted from the apparatus body, and that traps dust that enters the dust collector together with an airflow, wherein the dust collector has an air inlet, and wherein the dust collector includes a shutter member that opens and closes the air inlet, and a sealing member stuck onto a region around the air inlet.

2. The waste toner container according to claim 1, wherein the dust collector has an air channel that extends so as to be bent relative to the air inlet and that allows the air to pass therethrough, and an air outlet that faces an outside of the dust collector, and wherein the dust collector includes a filter that is disposed in the air channel and that traps the dust that enters the filter together with the airflow.

3. The waste toner container according to claim 2, wherein the waste toner container body has a second end, wherein the waste toner container body includes a handle that is formed on a second end side of the waste toner container body and that is held when the waste toner container body is attached or detached, and an engagement portion that is provided on the first end side of the waste toner container body and that is engaged with the dust collector, and wherein the dust collector is engaged with the engagement portion so as to be integrated with the waste toner container body.

4. The waste toner container according to claim 3, wherein the waste toner container body has a first through hole and the dust collector has a second through hole, and wherein the waste toner container body and the dust collector are connected to each other through the first through hole and the second through hole so as to be integrated with each other.

5. The waste toner container according to claim 2, wherein the waste toner container body has a first through hole and the dust collector has a second through hole, and wherein the waste toner container body and the dust collector are connected to each other through the first through hole and the second through hole so as to be integrated with each other.

6. The waste toner container according to claim 1, wherein the waste toner container body has a second end, wherein the waste toner container body includes a handle that is formed on a second end side of the waste toner container body and that is held when the waste toner container body is attached or detached, and an engagement portion that is provided on the first end side of the waste toner container body and that is engaged with the dust collector, and wherein the dust collector is engaged with the engagement portion so as to be integrated with the waste toner container body.

7. The waste toner container according to claim 6, wherein the waste toner container body has a first through hole and the dust collector has a second through hole, and wherein the waste toner container body and the dust collector are connected to each other through the first through hole and the second through hole so as to be integrated with each other.

8. The waste toner container according to claim 1, wherein the waste toner container body has a first through hole and the dust collector has a second through hole, and wherein the waste toner container body and the dust collector are connected to each other through the first through hole and the second through hole so as to be integrated with each other.

9. An image forming apparatus comprising:

an apparatus body;

a waste toner container comprising a waste toner container body that has a first end and that stores waste toner discharged from an apparatus body and a dust collector that is disposed on a first end side of the waste toner container body, that allows passage therethrough of air to be exhausted from the apparatus body, and that traps dust that enters the dust collector together with an airflow; and an air exhaust fan, wherein the waste toner container has an air inlet and an air outlet, wherein the image forming apparatus has an air channel that is open in the apparatus body and that is connected to the air inlet of the waste toner container, and wherein the air exhaust fan faces the air outlet of the waste toner container and exhausts to an outside of the apparatus body the air which has passed through the dust collector of the waste toner container and which has been exhausted through the air outlet of the waste toner container.

* * * * *